US005934966A

United States Patent [19]

Ward

[11] Patent Number: 5,934,966

[45] **Date of Patent: *Aug. 10, 1999**

[54] THROWABLE AERODYNAMIC DISC

[76] Inventor: William A. Ward, 2023 Old Natchez Trace, Franklin, Tenn. 37064

[ * ] Notice: This patent issued on a continued prosecution application filed under 37 CFR 1.53(d), and is subject to the twenty year patent term provisions of 35 U.S.C. 154(a)(2).

[21] Appl. No.: 08/709,991

[22] Filed: Sep. 9, 1996

[51] Int. Cl.[6] ..... A63B 65/10

[52] U.S. Cl. ..... 446/46; 473/588

[58] Field of Search ..... 446/46, 47, 48; 473/588, 589

[56] References Cited

U.S. PATENT DOCUMENTS

| | | | |
|---|---|---|---|
| 3,082,572 | 3/1963 | Knox | 473/589 |
| 3,508,360 | 4/1970 | Williams | 446/46 |
| 3,802,117 | 4/1974 | Engelhardt | 446/46 |
| 4,132,030 | 1/1979 | Lehman . | |
| 4,134,229 | 1/1979 | Lehman | 446/47 |
| 4,153,252 | 5/1979 | Sullivan | 473/588 |
| 4,183,168 | 1/1980 | Ross | 446/46 |
| 4,216,611 | 8/1980 | Psyras . | |
| 4,216,962 | 8/1980 | Flemming | 446/46 |
| 4,248,010 | 2/1981 | Fox | 473/588 |
| 4,253,269 | 3/1981 | Sullivan . | |
| 4,919,083 | 4/1990 | Axelrod . | |
| 5,055,080 | 10/1991 | Cwalinski et al. . | |
| 5,173,070 | 12/1992 | Gould | 473/589 |
| 5,195,916 | 3/1993 | Her . | |
| 5,297,799 | 3/1994 | Slater et al. | 473/588 |
| 5,360,363 | 11/1994 | Levin | 446/46 |

OTHER PUBLICATIONS

Tee–Bird product brochure, Jun. 1984.

*Primary Examiner*—Robert A. Hafer
*Assistant Examiner*—Jeffrey D. Carlson
*Attorney, Agent, or Firm*—Dority & Manning, PA

[57] ABSTRACT

An improved aerodynamic disc comprised of a disc shaped center, a circumferential rim portion, and a protrusion extending from one surface of the disc shaped center. The protrusion extends beyond the circumferential rim portion to provide a resting support surface. This resting support surface when combined with the resting support surface of the circumferential rim portion in contact with the landing surface provides an opposing elevated rim portion which is designed to aid a pet or a person to retrieve the aerodynamic disc from the landing surface. The protrusion may be permanently affixed or removable and attachment members such as including a whistle element or a light element may be attached to the center shaped disc in addition to the protrusion.

1 Claim, 2 Drawing Sheets

THROWABLE AERODYNAMIC DISC

BACKGROUND OF THE INVENTION

This invention generally relates to aerodynamic discs and in particular to a throwable toy to be used by humans in throwing games with animals, particularly dogs.

Throwable toys resembling inverted platters, saucers, or discs have enjoyed great popularity as recreational items for use in throwing games and contests. In a typical embodiment the throwable toy is made of plastic material in a circular configuration with a rim portion located at its periphery, the rim portion being relatively thick in comparison to the remaining portions of the implement. various materials may be used, such as flexible but durable plastic. See, for example, U.S. Pat. No. 4,253,269, the disclosure of which is incorporated herein by reference.

In a conventional inverted platter orientation, the rim curves downwardly from the toy body giving the implement a shape which approximates that of an airfoil when viewed in side elevation. Such a toy, for example, has been marketed under the trademark "FRISBEE" by the Wham-O-Corp. of San Gabriel, California the assignee of U.S. Pat. No. 3,724,122 issued Apr. 3, 1973.

In throwing games, the toy is typically grasped with the thumb of one hand on the convex side of the saucer and with one or more of the fingers of the same hand on the concave side. Throwing is accomplished with a wrist snapping and/or arm snapping motion wherein the thrower assumes a stance approximately at a right angle to the intended target and retracts his arm across his body. By uncoiling his arm and/or snapping his wrist, momentum and spin is imparted from the user to the saucer to cause it to fly or glide toward another participant in a game or in some cases toward an inanimate target. The intricacies of the flight path from the thrower depend at least in part on the thrower's skill in selecting speed and spin, and the desired release point and the angle of the saucer relative to the ground when it is released.

One appeal of such a toy resides in the fact that it exhibits definite aerodynamic characteristics. This means that an experienced user can cause the thrown or sailed object to do in-flight maneuvers of various kinds. Such toys can also be caused to glide over substantial distances, and are relatively easy to master, further factors contributing to their popularity as an article of recreation.

Many dog trainers and breeders believe a healthy and beneficial exercise for a dog is retrieving. Not only that, but both dogs and their owners appear to greatly enjoy "playing fetch." The most common image of this mutually pleasurable game is the dog furiously and happily racing after a thrown stick or a rubber ball. Using a flying disc as described above enhances this game, adding a new and exciting dimension to the ancient game between Man and his "Best Friend", since the disc is also catchable in flight by a well trained and skilled pet.

However, unlike Man, a dog, like many other animals, lacks the opposable thumb of primates, e.g., mankind, which allows for easy grasping of materials. As a result, animals without opposable thumbs, e.g., dogs and cats, usually carry items by grasping them between their jaws. In most situations, this method of grasping is adequate. However, due to the configuration of conventional flying discs, when the disc is lying stationary, flat and upon the ground, i.e., with is underside facing downwardly, it is difficult for the animal to pick up the disc because of the flat surface which is presented. Such fact greatly lessens the enjoyment of the game if the thrower has to retrieve it himself, and can tend to frustrate the pet.

If the disc lands with its underside facing upwardly, a dog can grip the disc with his teeth. However, a more typical landing is for the disc to land with it underside down.

U.S. Pat. No. 4,919,083 seeks to address such "grip" problem by adding a relatively substantial bone-like structure attached to the top of the disc as a handle. Such a design increases drag and air friction resulting in poorer flight characteristics.

SUMMARY OF THE INVENTION

The present invention recognizes and addresses various of the foregoing problems, and others, concerning recreational use of flying discs. Thus, broadly speaking, a principal object of this invention is improved recreational use of flying discs. More particularly, a main concern is improved enjoyment of such flying discs by improving their ability to be picked up from a resting surface without adversely impacting the quality or predictability of their flight characteristics.

Still further, it is another object to provide such an improved flying disc without changing the basic operation thereof, so as to alleviate the need for a new learning curve for a user already familiar with more conventional recreational flying discs.

A more particular present object of this invention to prevent the disc from lying stationary, flat and upon the ground through the introduction of at least one protrusion from the underside of the disc that extends beyond the depth of the disc a significant enough length such as to prevent the disc from resting flat upon the surface where it lands. Therefore, the present invention will either land as might a conventional disc with its underside facing upwardly, or land so as to have a portion thereof at an elevation above the surface where the disc is supported by an edge of the disc and at least one of the extending protrusions.

Another purpose of the present invention is to facilitate its retrieval by a pet.

An additional purpose includes the ability to attach removable attachments including, but not limited to, a center light, a whistle, or an aerodynamic alteration element i.e., selective altering of the disc aerodynamics, such as for greater lift or selected turning features connected to the center of the disc.

Additional objects and advantages of the invention are set forth in, or will be apparent to those of ordinary skill in the art from, the detailed description which follows. Also, it should be further appreciated that modifications and variations to the specifically illustrated and discussed features, materials, and devices hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts, features, or the like.

Still further, it is to be understood that different embodiments, as well as different presently preferred embodiments, of this invention may include various combinations or configurations of presently disclosed features or elements, or their equivalents (including combinations or configurations of features thereof not expressly shown in the figures or stated in the detailed description).

In one presently preferred embodiment, the throwable disc has a single projection extending downward beyond the concave rim of a disc. This protrusion does not present a significant surface area to increase air friction and drag of the flying toy. Instead, the protrusion will increase the gyroscopic effect of the aerodynamic toy, promoting the tendency for the toy to glide at an aspect parallel to the ground. This protrusion does not significantly alter the weight distribution of the aerodynamic disc. Furthermore, because the protrusion extends significantly beyond the rim of the flying disc, the disc will not lie flat along the rim of the flying disc when it is in contact with the ground. The disc will either flip over to land with its upper surface in contact with the ground or will land so that an edge of the rim of the toy and the protrusion support the toy on the ground. In this manner, an elevated rim of the toy opposite the portion of the rim in contact with the ground is at a height above the ground, which will aid an animal (e.g., a dog) to grab it with its mouth.

An alternative embodiment contemplates a mount attached to the disc shaped center which allows for a variety of attachments to be attached and removed. These and other objects and advantages of the invention will become apparent from the following more detailed description, when taken in conjunction with the accompanying drawings of the illustrative embodiments.

BRIEF DESCRIPTION OF THE DRAWINGS

A full and enabling disclosure of the present invention, including the best mode thereof and directed to one of ordinary skill in the art, is set forth in the specification, which makes reference to the appended drawings, in which.

Figure 1:
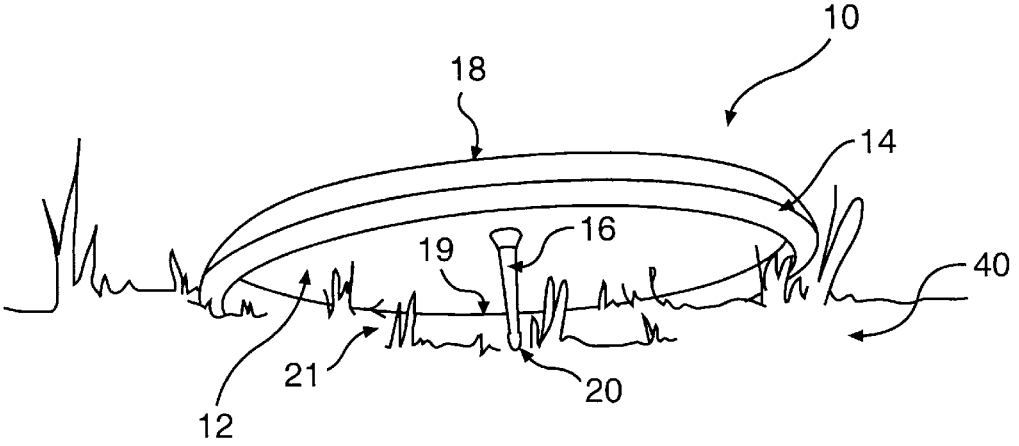
FIG. 1 is a generally side and slightly bottom perspective view of an exemplary aerodynamic disc in accordance with the present invention, and illustrated at rest on a resting or landing surface.
Figure 2:
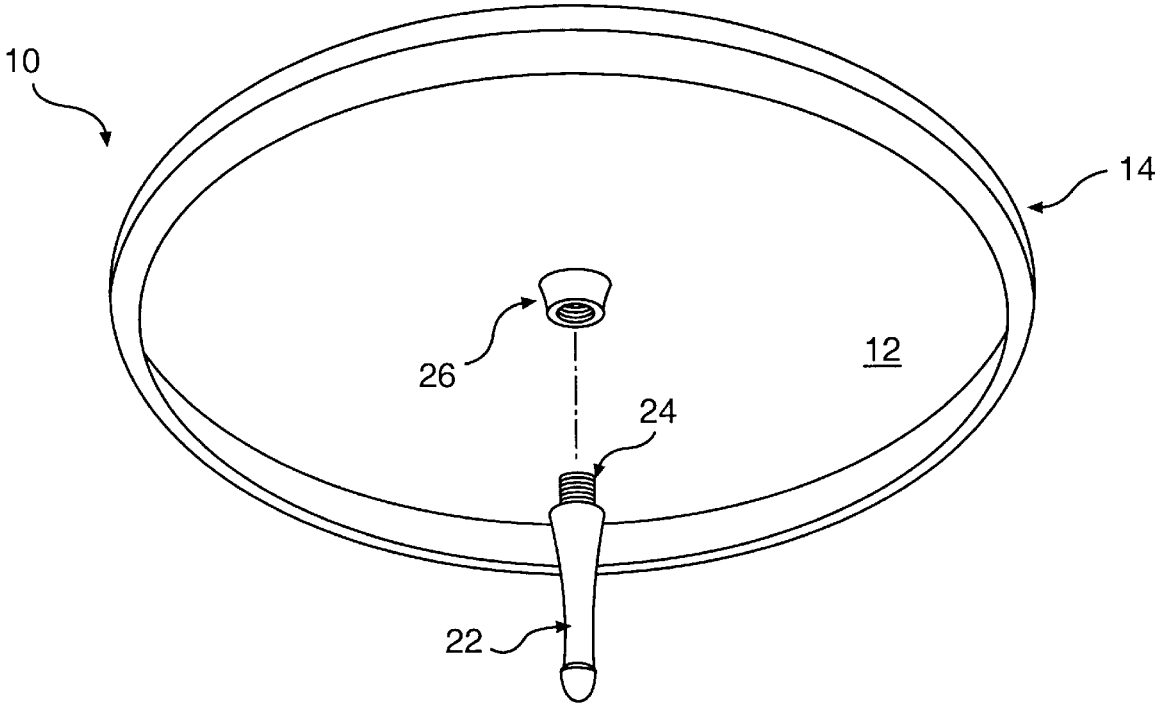
FIG. 2 is an exploded side and bottom perspective view of the aerodynamic disc exemplary embodiment of FIG. 1.

Repeat use of reference characters in the present specification and drawings is intended to represent same or analogous features or elements of the invention.

DETAILED DESCRIPTION OF THE PREFERRED EMBODIMENTS

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on or with another embodiment to yield a still further embodiment. Thus, it is intended that the present invention covers such modifications and variations as come within the scope of the appended claims and their equivalents.

The present invention is concerned with an improved aerodynamic disc, such as for recreational use. Accordingly, FIGS. 1 through 4 depict presently preferred embodiments of an aerodynamic disc generally 10. FIG. 1 represents an aerodynamic disc 10 having respective convex upper and concave lower surfaces at rest on a landing or resting surface generally 40. Such exemplary aerodynamic disc 10 is comprised of a disc shaped center 12, a circumferential rim portion 14, and a protrusion 16.

The protrusion 16 is preferably non-rotatably attached to a single surface portion of the aerodynamic disc 10. The protrusion 16 extends generally perpendicularly to the surface of the aerodynamic disc 10 (i.e., an axis extending in the plane of element 12 near its center from which protrusion 16 projects). Furthermore, protrusion 16 extends a distance beyond the edge of the circumferential rim portion 14. Such projection or extension distance may be predetermined. Preferably, such distance is one-half of an inch to three inches.

However, it is also preferred that the length of the protrusion 16 be limited to prevent the angle of the aerodynamic disc 10 with respect to the surface 40 from exceeding about 45 degrees when the aerodynamic disc 10 is at rest on a surface 40. Those of ordinary skill in the art will appreciate without further explanation that such actual angle would depend on several factors, including at least the above-referenced extension or protrusion 16 and the geometrical affect of the radius of center 12. Preferably, such center 12 has a diameter at least about three times greater than its height. See, for example, angle 17 formed by the exemplary configuration of present FIG. 3.

Additionally, the presence of protrusion 16 will increase the gyroscopic effect of the aerodynamic disc 10 to increase flight performance. Furthermore, the shape of the protrusion 16 may be optimized to minimize surface area to reduce wind drag. Alternately, wind drag may be desirable to limit flight distance when the aerodynamic disc 10 is utilized with smaller pets.

Figure 3:
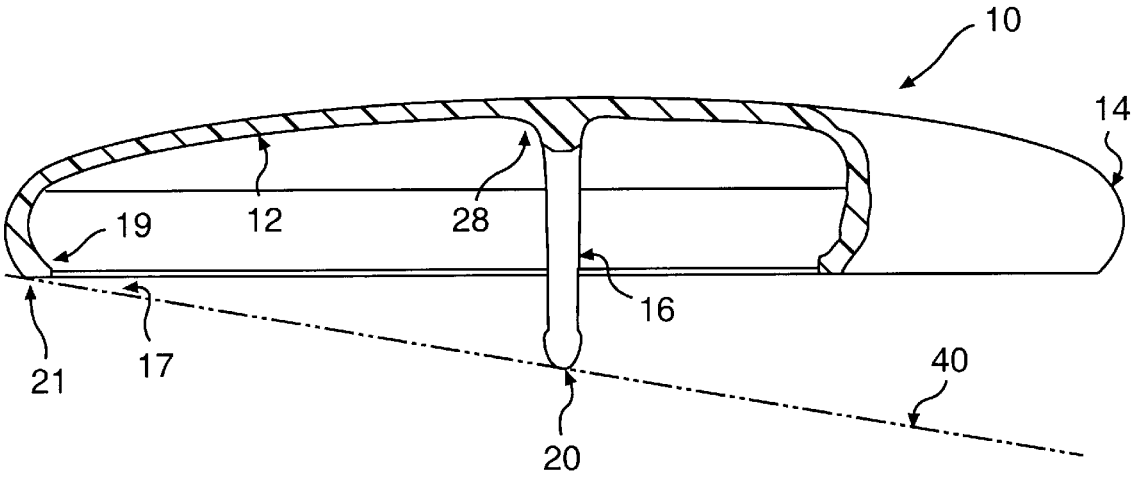
FIG. 3 is a partial cross sectional view (in partial cutaway) of an alternate exemplary embodiment of an aerodynamic disc in accordance with the present invention.

At rest, the aerodynamic disc 10 will have an elevated portion generally 18 that is at a higher elevation than the surface 40 on which aerodynamic disc 10 rests. When the disc is at rest such as represented in FIGS. 1 and 3, the protrusion 16 and a predetermined arc generally 19 of the circumferential rim portion 14 comprise respective resting portions generally 20 and 21 which support the aerodynamic disc 10 on a surface 40 (i.e., where contact is actually made between disc 10 and surface 40). The predetermined arc generally 19 of the circumferential rim portion comprises substantially less than one-half of the total circumference of the circumferential rim portion 14. The actual amount of the circumferential rim portion 14 in contact with the surface 40 will vary depending on the surface 40 on which the aerodynamic disc 10 rests.

In an exemplary presently preferred embodiment, the protrusion 16 includes a first extending portion generally 22 comprising a resilient member 22 (see FIG. 2) having adequate rigidity to support aerodynamic disc 10 at rest on surface 40 and also having adequate flexibility to bend upon contact with a predetermined force. Furthermore, once the protrusion 16 is bent, the protrusion 16 has sufficient resiliency to return to its approximately original configuration upon removal of the applied force. One example of such a predetermined force might be if a user or a retrieving pet inadvertently stepped on the disc 10.

Resilient member 22 in the presently preferred embodiments may be comprised, for example, of a flexible plastic material, but could alternately incorporate a metallic spring (such as an elongated and shaped coil spring, similar to a "doorstop" type device). Disc 10 itself may be formed of suitable plastic materials, such as already known to those of ordinary skill in the art.

A second attachment portion 24 of the protrusion 16 is used to attach the removable protrusion 16 to the disc shaped center 12 at a base 26 thereof. For example, elements 24 and 26 may be complementarily threaded for respective mating operations, or other equivalent attachment mechanisms may be used.

Those of ordinary skill in the art will appreciate and understand that element 24 (and hence element 22 integral therewith) is rotated in this exemplary embodiment relative to element 12. However, it is understood that once element 24 is properly mounted to element 12 (even when removably mounted), element 24 is properly regarded as being non-rotatably mounted relative to element 12.

In an alternate embodiment shown in FIG. 3, the protrusion 16 is illustrated as alternately comprising a non-removable attachment 28 associated with the disc shaped center 12.

Figure 4:
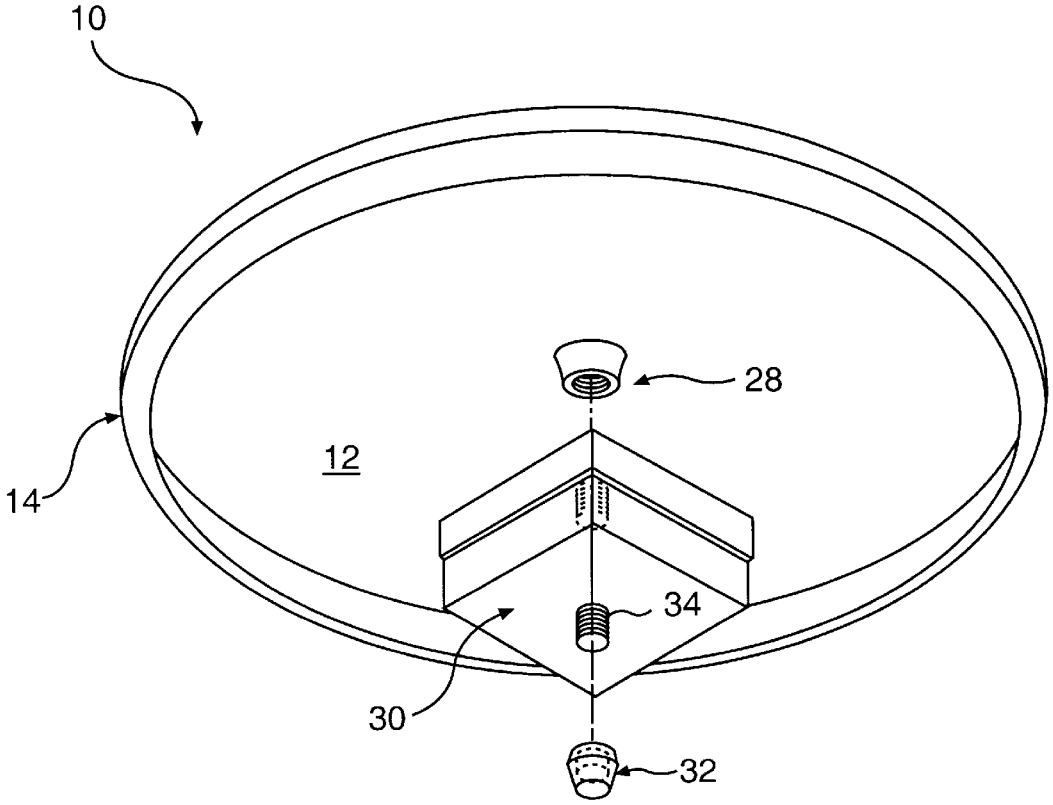
FIG. 4 is an exploded generally bottom and side perspective view of a further exemplary embodiment of an aerodynamic disc in accordance with the present invention, and equipped with an attachment device per this invention.

In yet another alternative embodiment illustrated in FIG. 4, the aerodynamic disc 10 includes an attachment member generally 30 ("diagrammatically" represented in block form) which may be one of either a whistle element, a lighting element, or an aerodynamic alteration element. Such alternative embodiment may further include a removable extension 32 attached (possibly by threads or functional equivalents) to a member 34 of the bottom surface of such attachment member 30.

While preferred embodiments of the invention have been described above, it is to be understood that any and all equivalent realizations of the present invention are included within the scope and spirit thereof. Thus, the embodiments depicted are presented by way of example and are not intended as limitations upon the present invention. Therefore, it will be understood by those of ordinary skill in the art that the present invention is not limited thereto since many modifications can be made. It is intended to be further understood that any and all such embodiments are included in the present invention as may fall within the literal or equivalent scope of the appended claims.

What is claimed is:

1. An aerodynamic disc, comprising:

a disc having a convex top, concave bottom and a depending peripheral rim extending downward a particular height, the concave bottom having a threaded mounting boss, the boss extending downward less than the height of the rim;

a flexible protrusion threadedly attachable to the boss so that when tightened, the protrusion is fixed to the boss in a non-rotatable configuration;

the protrusion extending significantly below the height of the rim so that when the disc comes to rest on the ground, it rests at an angle and is supported by the protrusion and a portion of the rim;

the protrusion being substantially flexible so that if the device is stepped upon by a user, the protrusion bends significantly under such force and will return to its original configuration upon the release of such force.

* * * * *